US008362386B2

(12) United States Patent
Lau et al.

(10) Patent No.: US 8,362,386 B2
(45) Date of Patent: Jan. 29, 2013

(54) POWER DELIVERY UNIT, PLASMA SPRAY SYSTEM, AND METHOD OF USING PLASMA SPRAY SYSTEM

(75) Inventors: Yuk-Chiu Lau, Schenectady, NY (US); Joseph Albanese, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 428 days.

(21) Appl. No.: 12/797,240

(22) Filed: Jun. 9, 2010

(65) Prior Publication Data

US 2011/0303645 A1 Dec. 15, 2011

(51) Int. Cl.
*H05H 1/00* (2006.01)

(52) U.S. Cl. ..... 219/121.47

(58) Field of Classification Search ..... 219/76.16, 219/121.47, 121.45, 76.15, 121.59, 121.5, 219/121.51, 121.48, 121.49, 121.46; 118/715; 426/426, 469, 457, 701, 702, 719; 427/449, 427/569, 576

See application file for complete search history.

(56) References Cited

U.S. PATENT DOCUMENTS 5,243,169 A * 9/1993 Tateno et al. ..... 219/121.51
6,248,976 B1 * 6/2001 Blankenship ..... 219/130.21

* cited by examiner

*Primary Examiner* — Dao H Nguyen
*Assistant Examiner* — Tram H Nguyen
(74) *Attorney, Agent, or Firm* — Nixon & Vanderhye P.C.

(57) ABSTRACT

Different plasma spray guns have differing current and voltage requirements for their operation. The spray guns generally fall into low voltage high current and high voltage low current types. The power requirements of the guns vary greatly in terms of overall power ranging from few tens of kilowatts to few hundreds of kilowatts. The guns also have wide ranging requirements for voltage and current. A power delivery unit is described in which the unit is capable of delivering the wide range of power as well as the wide ranges of voltage and current. A plasma spray system with such power delivery unit can universally operate both the low voltage high current and high voltage low voltage spray gun types. Such system can reduce capital and operation costs since shops need not maintain separate and incompatible plasma spray systems.

26 Claims, 5 Drawing Sheets

POWER DELIVERY UNIT, PLASMA SPRAY SYSTEM, AND METHOD OF USING PLASMA SPRAY SYSTEM

An aspect of the present invention relates to one or more plasma spray systems capable of operating plasma spray guns ranging from high voltage low current types to low voltage high current types. Another aspect relates to one or more power delivery units for use in such plasma spray systems. Yet another aspect relates to one or more methods of using the plasma spray systems.

BACKGROUND OF THE INVENTION

Plasma spraying is a form of a thermal spraying technique for use in a coating process to coat a target surface with a coating material. Different coating materials, usually provided in a powder form, are used to provide desired surface characteristics. Materials can be chosen to provide protection against high temperatures such as ceramic coatings on gas turbines for power generation and aircraft. Metallic materials can be coated on steam turbines for protection against mechanical wear. In some instances, materials that are same or similar to the target part can be coated to the target part surface and coated part can be remachined for repairs. In other instances, materials can be chosen for their electrical properties—e.g., for their electrically conductive or insulative properties depending on the application.

Different plasma spray guns have varying power supply requirements, but can be generally divided into two types—low voltage high current (LVHC) and high voltage low current (HVLC). LVHC guns typically have small physical separation between the cathode and the anode. Voltage necessary to form an electrical arc between the cathode and the anode is directly proportional to the physical separation between the cathode and the anode. Thus, a relatively small voltage (about 100 VDC) is sufficient to form the electrical arc in LVHC guns. However, since the thermal energy of the plasma is dependent on the power, relatively high amount of current (upwards of 1000 A) is needed to provide sufficient energy. The power supply that powers LVHC guns thus operates in the LVHC mode, i.e., ≦1000 A and ≦100 VDC. Examples of the LVHC spray guns include Sulzer Metco® (registered trademark of Sulzer Metco Management AG, Zürcherstrasse 12 Winterthur CH8400, Switzerland) 7MB/9MB and O3C guns and Praxair® (registered trademark of Praxair Technology, Inc., 55 Old Ridgebury Road, Danbury, Conn. 06815) SG-100 guns.

Conversely, HVLC guns operate with larger separation between the cathode and the anode. As a result, a relatively high voltage (≦400 VDC) is required to form the electric arc. However, less current (upto 600 A) is required to generate the necessary thermal energy since power is the product of voltage and current. The HVLC guns require power supplies to operate in the HVLC mode, i.e., ~600 A and ≦400 VDC. The HVLC guns such as the Praxair® Plazjet gun operates in the 200 kW range and Progressive Surface® 100HE® (registered service mark and trademark of Progressive Technologies, Inc., 4695 Danvers Drive SE, Kentwood, Mich. 49512) gun operates in the 100 kW range.

Unfortunately, conventional HVLC and LVHC systems are generally not compatible with each other. An LVHC plasma spray gun cannot be operated using an HVLC power supply designed for an HVLC gun. Conversely, an HVLC gun cannot be operated using an LVHC power supply designed for an LVHC gun. As a result, a shop having both types of guns must purchase and maintain two types of plasma spray systems to operate the different plasma spray gun types. This leads to high equipment cost, and also leads to lack of standardization in the shops. This is a particular problem for shops that operate globally.

BRIEF SUMMARY OF THE INVENTION

A non-limiting aspect of the present invention relates to a power delivery unit for a plasma spray system. The power delivery unit may include a plurality of power supplies whose outputs are connected in parallel. Each power supply may be arranged to output DC power to a plasma spray gun connected to the power delivery unit and to operate in a constant current mode. Each power supply may be arranged to automatically output a first DC voltage when an arc length of the plasma spray gun is a first arc length and automatically output a second DC voltage different from the first DC voltage when the arc length of the gun is a second arc length different from the first arc length. The first and second DC voltages are sufficient to sustain the first and second arc lengths respectively.

Another non-limiting aspect of the present invention relates to a plasma spray system, which may comprise a plasma spray gun, a powder feed unit, a process gas unit, a power delivery unit, and a control unit. The plasma spray gun may be arranged to spray a coating material to a target surface, the powder feed may be arranged feed the coating material to the plasma spray gun, the process gas unit may be arranged to deliver process gas to the plasma spray gun, the power delivery unit may be arranged to provide DC power to the plasma spray gun, and the control unit may be arranged to control an amount of current delivered by the power delivery unit to the plasma spray gun. The power delivery unit may include a plurality of power supplies whose outputs are connected in parallel. Each power supply may be arranged to output DC power to a plasma spray gun connected to the power delivery unit and to operate in a constant current mode. Each power supply may be arranged to automatically output a first DC voltage when an arc length of the plasma spray gun is a first arc length and automatically output a second DC voltage different from the first DC voltage when the arc length of the gun is a second arc length different from the first arc length. The first and second DC voltages are sufficient to sustain the first and second arc lengths respectively.

Yet another non-limiting aspect of the present invention relates to a method of using a plasma spray system for coating a target surface. In the method, a powder feed unit may be used to feed a coating material to a plasma spray gun, and a process gas unit may be used to deliver process gas to the plasma spray gun. Also in the method, a plurality of power supplies operating in a constant current mode and whose outputs are connected in parallel, may be used to provide DC power to the plasma spray gun. When providing the DC power, the plurality of power supplies may automatically output a first DC voltage when an arc length of the plasma spray gun is a first arc length and automatically output a second DC voltage different from the first DC voltage when the arc length of the gun is a second arc length different from the first arc length. The first and second DC voltages are sufficient to sustain the first and second arc lengths respectively.

The invention will now be described in greater detail in connection with the drawings identified below.

DETAILED DESCRIPTION OF THE INVENTION

Figure 1:
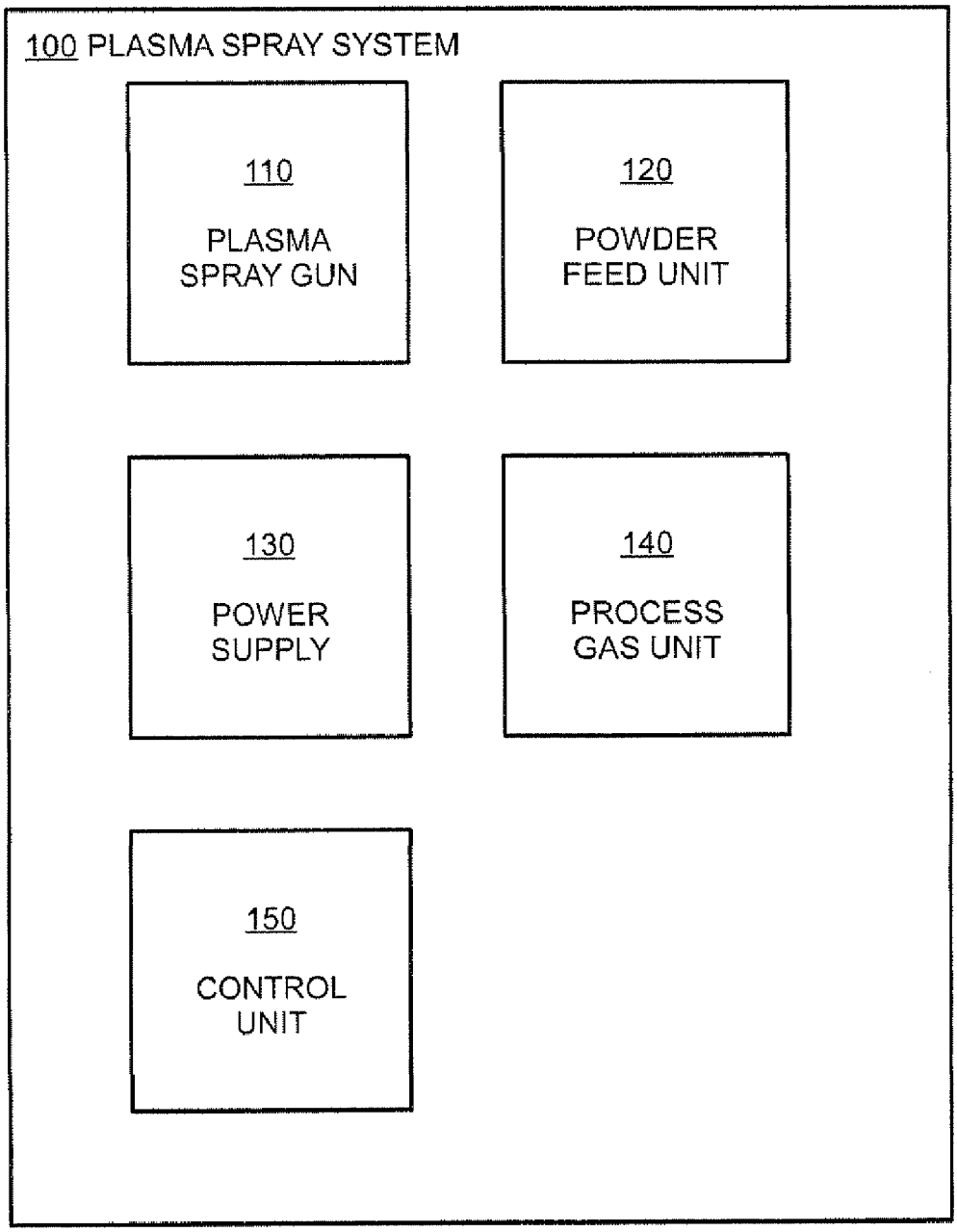
FIG. 1 illustrates typical components of a plasma spray system.

FIG. 1 illustrates typical components that make up a plasma spray system. As illustrated, the plasma spray system 100 includes a plasma spray gun 110, a powder feed unit 120, a power supply 130, a process gas unit 140 and a control unit 150. There are also other components such as heat exchangers and water chillers to cool the spray gun 110 as it operates, but are omitted for clarity. The cathode and anode electrodes of the spray gun 110 are electrically connected to the power supply 130, and the amount of power the power supply 130 provides is controllable through the control unit 150.

In operation, process gas or gases (e.g., nitrogen, argon, hydrogen, and helium) provided through the process gas unit 140 are passed between the cathode and the anode electrodes of the spray gun 110 where an electrical arc is formed. When the process gas passes through the electrodes of the plasma spray gun 110, the arc strips electrons from the process gas molecules to form a plasma, which is very unstable. A large amount of thermal energy is released as the plasma ions recombine back to stable gases. The thermal energy release is so great that the temperature can reach over 10,000 K. The powder feed unit 120 feeds the powder coating material into the plasma, which melts the coating material due to the tremendous heat. The melted coating material is then sprayed on to the target surface to form the coating. The electrical arc is maintained, i.e., the arc length is sustained, by the power supply 130. Typically, direct current (DC) power is provided to the cathode and the anode of the spray gun 110.

It is mentioned above that commercial LVHC and HVLC plasma spray systems are generally incompatible with each other. This is primarily due to a combination of wide ranging voltage requirements and wide ranging current requirements of the different spray gun types. It is generally true that an LVHC gun, while requiring less voltage (e.g., 100 VDC vs. 300 VDC), requires a much greater amount of current (e.g., 1000 A vs. 600 A) than an HVLC gun.

Conventionally, the power supplies in commercial plasma spray system are specifically tailored to the types of spray guns. For example, a 100 kilowatt (kW) LVHC power supply capable of delivering 1000 A of current at 100 VDC will be sufficient to operate the typical LVHC gun (e.g., Sulzer Metco® 7 MB/9 MB and O3C guns). However, this LVHC power supply cannot be used to power the HVLC gun (such as the Progressive Surface® 100HE® gun) simply because it lacks the requisite high voltage capability to sustain the necessary long arc length typical in the HVLC gun.

On the other hand, a 180 kW power supply capable of delivering 600 A of current at 300 VDC will enable operation of the typical HVLC gun such as the Praxair® Plazjet gun. While the HVLC power supply may meet the total power requirements of the typical LVHC gun, the power supply still cannot be used to power the LVHC gun because it lacks the required current capability.

It may appear that a straight forward solution is to produce a power supply with sufficient voltage and sufficient current capabilities. While straight forward in theory, this is a challenging task in reality. For generally available plasma spray guns in the market, the overall power requirements vary greatly, i.e., between 50 kW and 200 kW, which is a substantial range. Producing a power supply with such broad range of power delivery capability is non-trivial. As far as the present inventors are aware, such power supply has not yet been built for commercial application and sale.

Complicating the matter are the differing voltage and current requirements of the guns. As mentioned, the LVHC guns do not require high voltage, but do require large amount of current. Conversely, the HVLC guns do not require large current amount, but do require high voltage. A power supply then must be vastly oversized to be able to supply the high voltage and the large current to handle both types of guns. In addition to the technical difficulties, this is a very expensive proposition. Even the conventional plasma spray systems in which the power supply is sized for the specific types of spray guns can cost $500 K or more.

These and other obstacles may have prevented the development of a power delivery system that can be used with many different plasma spray guns. The inventors of the present subject matter have overcome the above-noted challenges and developed a plasma spray system that is believed to be universally applicable to most, if not all, types of plasma spray guns available in the market.

Figure 2:
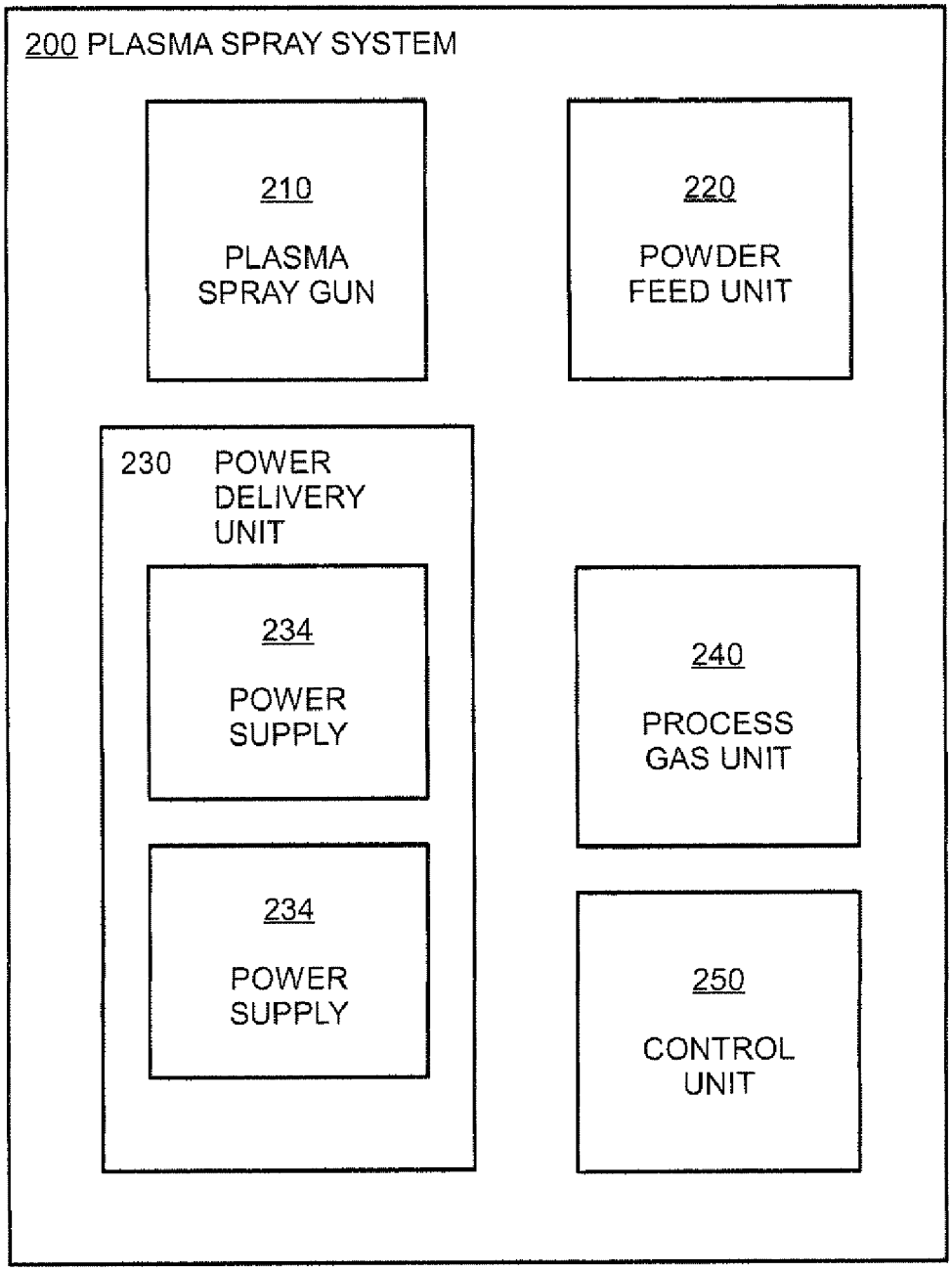
FIG. 2 illustrates components of a non-limiting embodiment of a plasma spray system according to the present invention.

FIG. 2 illustrates a non-limiting embodiment of the plasma spray system. As seen, the plasma spray system 200 may include a plasma spray gun 210, a powder feed unit 220, a process gas unit 240, a power delivery unit 230, and a control unit 250. The plasma spray gun 210 may be arranged to spray a coating material to a target surface. The gun 210 may be an air plasma spray gun that operates under atmospheric pressure or it may be a gun that operates in low pressure environments. That is, the system 200 may be an air plasma spray system or a low pressure plasma spray system.

The powder feed unit 220 may be arranged to feed the coating material to the plasma spray gun 210, and the process gas unit 240 may be arranged to deliver the process gas to the plasma spray gun 210. Process gases may include nitrogen, argon, hydrogen, and helium or any combination thereof. In general, inert gases may be used with mixtures. The power delivery unit 230 may electrically connect to the plasma spray gun 210 to provide DC power to the gun 210, and the control unit 250 may be arranged to control an amount of current delivered by the power delivery unit 230 to the plasma spray gun 210.

As shown in FIG. 2, an example of the inventive power delivery unit 230 may include a plurality of power supplies 234. Preferably, each power supply 234 may be an HVLC power supply capable of outputting a wide range of DC voltage. Also preferably, each power supply 234 may operate in a constant current mode. In the figure, only two power supplies 234 (first and second) are illustrated. However the invention is not so limited, i.e., more than two HVLC constant current power supplies 234 are contemplated.

Regarding the VDC output range of the power supplies 234, it should be appreciated that the maximum output voltage capability depends on the components of the power supply such as transformers and rectifiers. The maximum voltage output can also depend on the input AC voltage. Thus in a non-limiting embodiment, at least one power supply 234 of the power delivery unit 230 may output a maximum VDC that is a predetermined factor of the input AC voltage. The input AC voltage may be expressed as root-mean-squared values or as peak values.

In one implementation, the output voltage range (combination of input AC and power supply components) can be 600 VDC or even higher. With typically available input AC voltages, the output range of each power supply 234 can be about 450 VDC in another implementation. It should be appreciated these voltage ranges are merely examples. The actual maximum output VDC capability of the power supplies is not limited to any specific numerical values.

Referring back to FIG. 2, the outputs of the power supplies 234 are connected in parallel (not shown), and each power supply 234 outputs DC power to the connected plasma spray gun 210. When a plurality of HVLC power supplies are connected in parallel, together the power supplies 234 may have the capability to output sufficient current amount to operate the LVHC spray guns. For reliability and safety, each power supply 234 may convert a three-phase input AC power to output the DC power. However, power supplies 234 receiving other inputs such as a single phase AC power are also contemplated.

The power supplies 234 may be arranged to output DC power at multiple DC voltages between a predetermined minimum and maximum including at least first and second DC voltages. For example, the first DC voltage may correspond to the voltage requirement of the LVHC guns (e.g., about 100 VDC) and the second DC voltage may correspond to the voltage requirement of the HVLC guns (e.g., about 350-450 VDC), the first and second DC voltages being voltages necessary to sustain the arc lengths of the LVHC and HVLC guns, respectively.

The power supplies 234 may automatically output DC power at the appropriate DC voltage, the appropriate voltage being a voltage sufficient to form and maintain the electrical arc between the cathode and the anode of the plasma spray gun 210. Preferably, the power supplies 234 may operate in the constant current mode. In this mode, for a specific set current and depending on the load (e.g., the arc length between the cathode and anode), the power supplies 234 automatically supply the appropriate voltage to sustain the arc lengths of the guns. In the case of LVHC guns, the power supplies 234 may automatically supply the first DC voltage. In the case of HVLC guns, the power supplies 234 may automatically supply the second DC voltage.

Also preferably, the power supplies 234 may be arranged to automatically output DC voltages at a plurality of discrete DC voltage levels between predetermined minimum and maximum DC voltages including the first and second DC voltages based on the load which, as noted, generally correspond to the arc lengths of the plasma spray guns 210. More preferably, the power supplies 234 may be arranged to automatically output a DC voltage in a continuous range between the predetermined minimum and maximum voltages depending on the arc length of the plasma spray gun 210 connected to the power delivery unit 230. As noted, the predetermined minimum can be 0 VDC and the predetermined maximum can be 600 VDC or even higher. For most or all commercially available plasma spray guns, maximum output of 450 VDC is likely to be sufficient.

Regardless of whether the output voltages are discrete or continuous, the DC voltage automatically output by the power supplies 234 is sufficient to sustain the arc length. That is, each power supply 234 may be arranged to automatically output the appropriate voltage to sustain a variety of arc lengths.

As noted, the plurality of power supplies 234 automatically output the appropriate DC voltage based on the arc length of the plasma spray gun 210 in one or more aspects. However, the amount of current output by the plurality of power supplies 234 is controllable through the control unit 250 which may be external to the power delivery unit 230.

In an aspect, the power supplies 234 can function as a current source that deliver a particular amount of current specified in a control signal received from the control unit 250. That is, the control signal specifies the amount of direct current to be delivered independent of the DC voltage being output by the plurality of power supplies 234. For example, if the control signal indicates that 300 A of current is to be output, the power supplies 234 together output 300 A regardless of whether the voltage automatically output by the power supplies 234 is the first or the second DC voltage. Of course, the total power output should not exceed the maximum power limit of the power supplies 234.

The power supplies 234 may all receive a common control signal from the control unit 250, each power supply 234 may receive an individualized control signal, or the power supplies 234 may be grouped and each group may receive a common control signal for the group. The manner in which the control signals are provided to the power supplies 234 is not limited as long as the power supplies 234 may be controlled to deliver the requisite amount of current.

While the number of power supplies 234 that can be connected in parallel is not particularly limited, combining two or three power supplies are most likely in practice. The power supplies 234 for use in plasma spraying are physically big and expensive to produce. For example, when two power supplies—first and second supplies 234—are connected, the combined power delivery unit 230 still can be as big as 3 ft×3 ft×8 ft (in a staged configuration) and can weigh as much as 4000 lbs for power supplies 234 with maximum output capability of substantially 450 VDC. For power supplies that can output 600 VDC or even higher, the size of the combined unit is likely to be even bigger.

Figure 3:
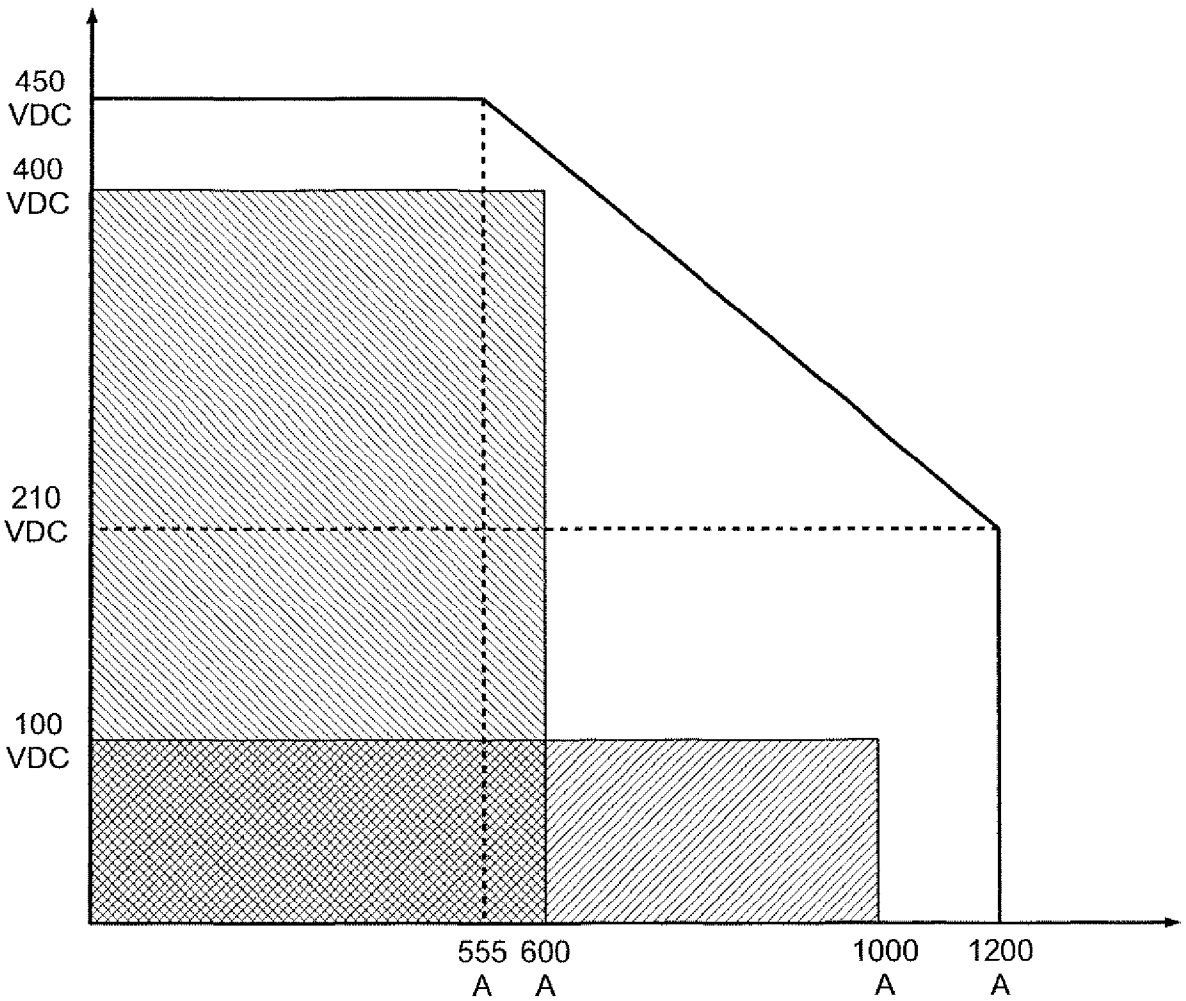
FIG. 3 illustrates an operating range of an example power delivery unit with two power supplies connected in parallel.

FIG. 3 illustrates an operating range of a power delivery unit 230 with two HVLC power supplies 234 connected in parallel in which each supply has a maximum output power capability of 125 kW, maximum voltage output capability of 450 VDC, and maximum current output capability of 600 A. Thus, the combined power delivery unit 230 has corresponding maximum capabilities of 250 kW, 450 VDC and 1200 A. As seen, at the maximum current of 1200 A, the output voltage can reach as high as 210 VDC. As the output voltage increases beyond 210 VDC, there is a corresponding drop in the output current due to the limitation on the maximum power. At the maximum output voltage of 450 VDC, the maximum current that can be output is 555 A.

In FIG. 3, two rectangles are also drawn. The first rectangle with dimensions 100 VDC and 1000 A (drawn with −45 degree hatching) represents the power, voltage, and current requirements of typical commercially available LVHC spray guns such as the 7 MB/9 MB and O3C guns. The second rectangle with dimensions 400 VDC and 600 A (drawn with +45 degree hatching) represents the requirements of typical commercially available HVLC guns such as the Plazjet and 100HE® guns. It is seen that a power delivery unit 230 with even just two HVLC power supplies 234 is sufficient to operate both types of plasma spray guns. Thus, in at least one aspect, the example power delivery unit 230 can be considered to be a universal power delivery unit for plasma spray guns and the plasma spray system 200 can be considered to be a universal plasma spray system.

Figure 4:
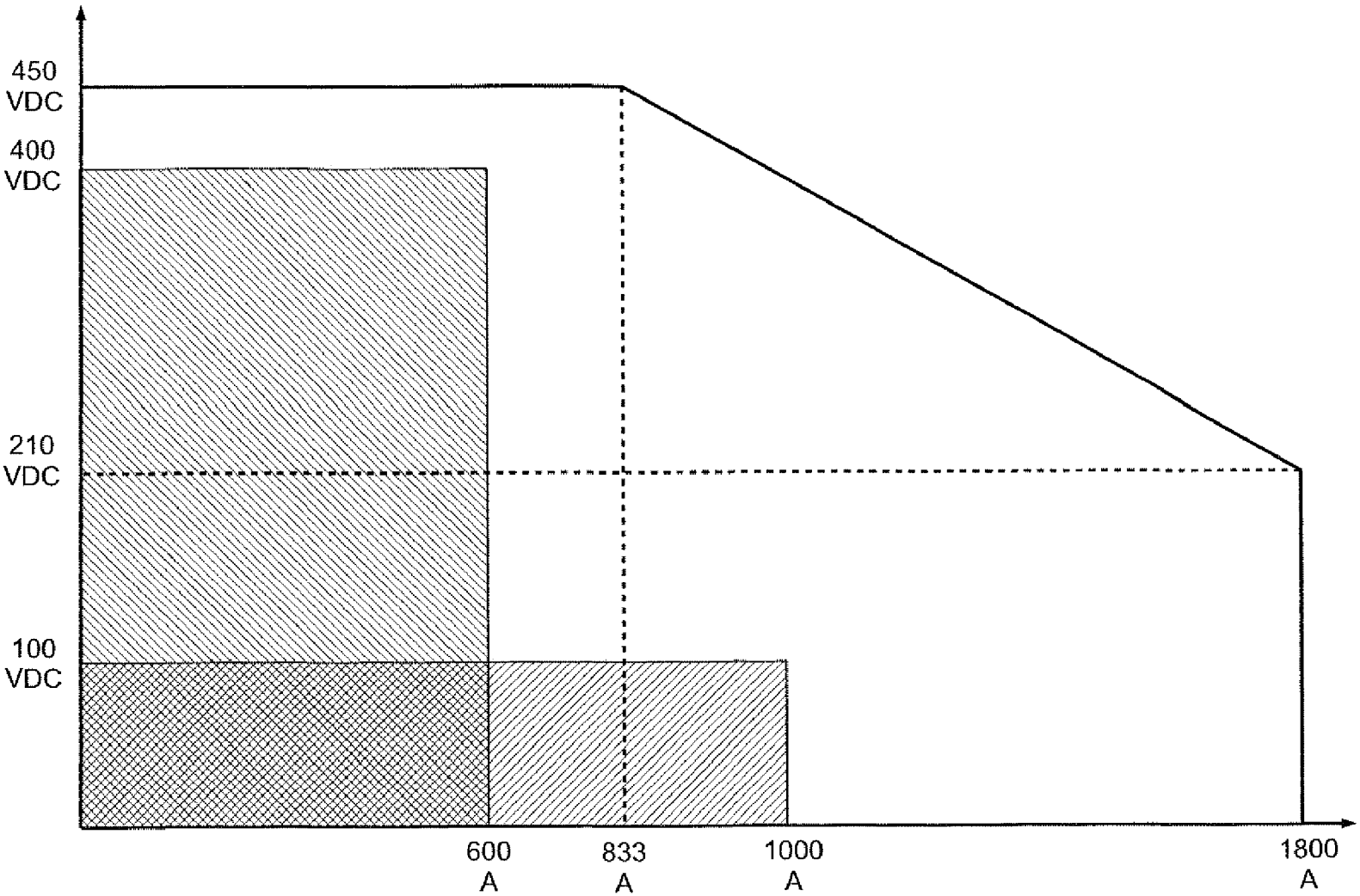
FIG. 4 illustrates an operating range of an example power delivery unit with three power supplies connected in parallel.

FIG. 4 illustrates the operating range of another power delivery unit 230 with three of the same power supplies 234 connected in parallel. Note the operating range is expanded to the right towards increased output current (and power) capability as more power supplies 234 are added. Again, the operating range is sufficient to universally operate typical commercially available plasma spray guns of all types.

FIGS. 3 and 4 illustrate one (of several) significant advantage of the present invention. Conventionally, to provide increases in both output VDC and current, the overall capability of a single power supply is needed to be increased, which as discussed is a very difficult task. Usually one is enhanced at the expense of the other due to power limitations. However, the present invention allows relatively straightforward approach to increase both by connecting in parallel as many power supplies with required VDC and current capabilities as necessary.

Figure 5:
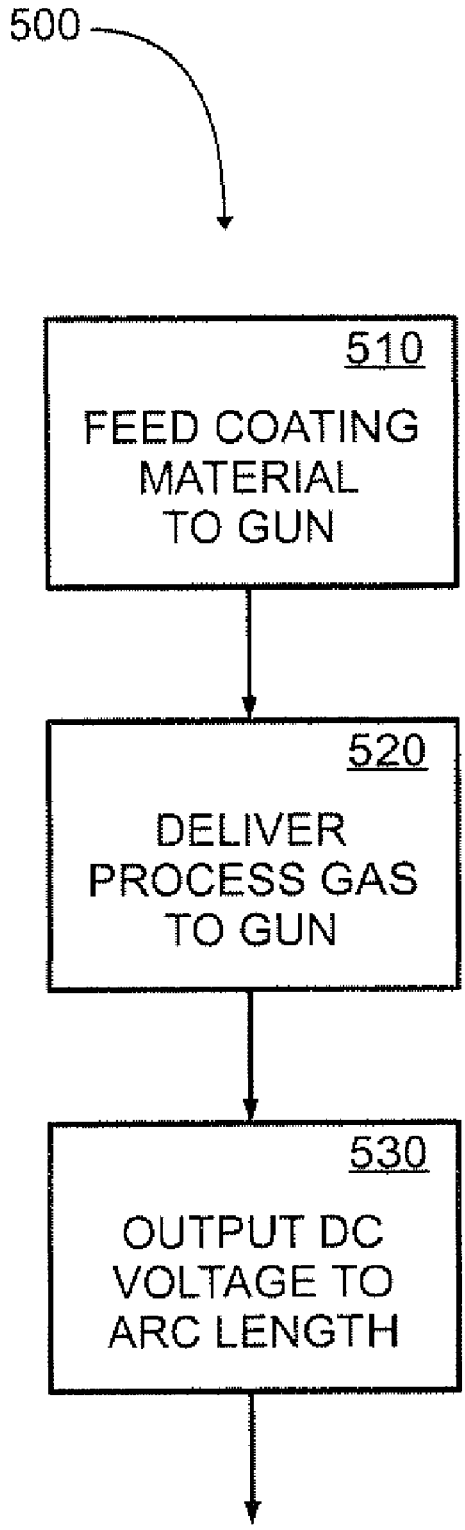
FIG. 5 illustrates a flow chart of a non-limiting example method of using a plasma spray system for coating a target surface.

FIG. 5 illustrates a flow chart of a non-limiting example method 500 of using a plasma spray system such as the system 200 for coating a target surface. In step 510, the powder feed unit 220 is used to feed the powder coating material to the air plasma spray gun 210. In step 520, the process gas unit 240 is used to deliver the process gas to the spray gun 210. In step 530, the power delivery unit 230 made up of the plurality of power supplies 234 operating in a constant current mode is used to output the appropriate DC voltage based on the arc length of the spray gun 210.

In one non-limiting implementation of step 530, the plurality of power supplies 234 are used to automatically output the first DC voltage when the arc length of the plasma spray gun 210 is the first arc length. Similarly, the power supplies 234 are used to automatically output second DC voltage when the arc length of the plasma spray gun 210 is the second arc length. As mentioned, the first and second DC voltages are sufficient to sustain the first and second arc lengths respectively. Also in step 530, the control unit 250 may be used to control the plurality of power supplies 234, which together deliver a specified amount of direct current to the plasma spray gun 210. Preferably, the first and second DC voltages are in a range of DC voltages capable of being output by the plurality of power supplies 234, the range being between the predetermined minimum and maximum DC voltages. For example, the example power delivery unit 230 comprising first and second power supplies 234 with the operating range as illustrated in FIG. 3 may be used.

It should be noted that the power delivery unit 230 may output more than just two DC voltages. Preferably, the power delivery unit 230 outputs DC voltages in a range, continuous or discrete, between predefined minimum and maximum voltages based on the arc length.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A power delivery unit for a plasma spray system, the power delivery unit comprising a plurality of power supplies whose outputs are connected in parallel, wherein each power supply is arranged to output DC power to a plasma spray gun connected to the power delivery unit, and wherein each power supply is arranged to operate in a constant current mode and automatically output a first DC voltage when an arc length of the plasma spray gun is a first arc length and automatically output a second DC voltage different from the first DC voltage when the arc length of the plasma spray gun is a second arc length different from the first arc length, the first and second DC voltages being respectively sufficient to sustain the first and second arc lengths.

2. The power delivery unit of claim 1, wherein the plurality of power supplies together are arranged to deliver an amount of direct current to the plasma spray gun based on a control signal from an external control unit.

3. The power delivery unit of claim 2, wherein the control signal from the external control unit specifies the amount of direct current to be delivered independent of the DC voltage being output by the plurality of power supplies.

4. The power delivery unit of claim 1, wherein the plurality of power supplies includes at least first and second power supplies respectively arranged to receive first and second control signals from an external control unit, the first and second power supplies together being arranged to deliver an amount of direct current to the plasma spray gun based on the first and second control signals from the external control unit.

5. The power delivery unit of claim 1, wherein the plurality of power supplies are arranged to output a DC voltage in a continuous range between predetermined minimum and maximum DC voltages based on the arc length of the plasma spray gun, the output DC voltage being sufficient to sustain the arc length of the plasma spray gun.

6. The power delivery unit of claim 1, wherein the plurality of power supplies are arranged to output a DC voltage in a range between predetermined minimum and maximum DC voltages based on the arc length of the plasma spray gun, the output DC voltage being sufficient to sustain the arc length of the plasma spray gun, and the output DC voltage being one of a plurality of discrete voltage levels within the range.

7. The power delivery unit of claim 1, wherein a maximum output VDC capability of at least one power supply is a predetermined factor of an AC voltage provided to the power supply as an input power.

8. The power delivery unit of claim 1, wherein the plurality of power supplies comprises at least first and second power supplies each being arranged to output a DC voltage substantially up to 600 VDC.

9. The power delivery unit of claim 1, wherein the plurality of power supplies comprises at least first and second power supplies each being arranged to output a DC voltage substantially up to 450 VDC.

10. A plasma spray system, comprising:

a plasma spray gun arranged to spray a coating material to a target surface;

a powder feed unit arranged feed the coating material to the plasma spray gun;

a process gas unit arranged to deliver process gas to the plasma spray gun;

a power delivery unit connected and arranged to provide DC power to the plasma spray gun; and a control unit arranged to control an amount of current delivered by the power delivery unit to the plasma spray gun, wherein the power delivery unit comprises a plurality of power supplies whose outputs are connected in parallel, each power supply being arranged to output DC power to the plasma spray gun, and wherein each power supply is arranged to operate in a constant current mode and automatically output a first DC voltage when an arc length of the plasma spray gun is a first arc length and automatically output a second DC voltage different from the first DC voltage when the arc length of the plasma spray gun is a second arc length different from the first arc length, the first and second DC voltages being respectively sufficient to sustain the first and second arc lengths.

11. The plasma spray system of claim 10, wherein the plurality of power supplies together are arranged to deliver an amount of direct current to the plasma spray gun based on a control signal from the control unit.

12. The plasma spray system of claim 11, wherein the control signal from the control unit specifies the amount of direct current to be delivered independent of the DC voltage being output by the plurality of power supplies.

13. The plasma spray system of claim 10, wherein the plurality of power supplies includes at least first and second power supplies respectively arranged to receive first and second control signals from an external control unit, the first and second power supplies together being arranged to deliver an amount of direct current to the plasma spray gun based on the first and second control signals from the external control unit.

14. The plasma spray system of claim 10, wherein the plurality of power supplies are arranged to output a DC voltage in a continuous range between predetermined minimum and maximum DC voltages based on the arc length of the plasma spray gun, the output DC voltage being sufficient to sustain the arc length of the plasma spray gun.

15. The power spray system of claim 10, wherein the plurality of power supplies are arranged to output a DC voltage in a range between predetermined minimum and maximum DC voltages based on the arc length of the plasma spray gun, the output DC voltage being sufficient to sustain the arc length of the plasma spray gun, and the output DC voltage being one of a plurality of discrete voltage levels within the range.

16. The plasma spray system of claim 10, wherein a maximum output VDC capability of at least one power supply is a predetermined factor of an AC voltage provided to the power supply as an input power.

17. The plasma spray system of claim 10, wherein the plurality of power supplies comprises at least first and second power supplies each being arranged to output a DC voltage substantially up to 600 VDC.

18. The plasma spray system of claim 10, wherein the plurality of power supplies comprises at least first and second power supplies each being arranged to output a DC voltage substantially up to 450 VDC.

19. The plasma spray system of claim 10, wherein the plasma spray system is an air plasma spray system.

20. The plasma spray system of claim 10, wherein the plasma spray system is a low pressure plasma spray system.

21. A method of using a plasma spray system for coating a target surface, the method comprising:

feeding, using a powder feed unit, a coating material to a plasma spray gun;

delivering, using a process gas unit, process gas to the plasma spray gun; and providing DC power, using a plurality of power supplies operating in a constant current mode and whose outputs are connected in parallel, to the plasma spray gun, wherein the step of providing the DC power to the plasma spray gun comprises automatically outputting, using the plurality of power supplies, a first DC voltage when an arc length of the plasma spray gun is a first arc length and automatically outputting a second DC voltage different from the first DC voltage when the arc length of the plasma spray gun is a second arc length different from the first arc length, the first and second DC voltages being respectively sufficient to sustain the first and second arc lengths.

22. The method of claim 21, wherein the step of providing the DC power to the plasma spray gun comprises controlling, using a control unit, the plurality of power supplies so that the plurality of power supplies together deliver a specified amount of direct current to the plasma spray gun.

23. The method of claim 21, wherein the step of providing the DC power to the plasma spray gun comprises outputting, using the plurality of power supplies, a DC voltage in a range between predetermined minimum and maximum DC voltages based on the arc length of the plasma spray gun, the output DC voltage being sufficient to sustain the arc length of the plasma spray gun.

24. The method of claim 21, wherein the step of providing the DC power to the plasma spray gun comprises using the plurality of power supplies in which a maximum output VDC capability of at least one power supply is a predetermined factor of an AC voltage provided to the power supply as an input power.

25. The method of claim 21, wherein the step of providing the DC power to the plasma spray gun comprises using at least first and second power supplies each being arranged to output a DC voltage substantially up to 600 VDC.

26. The method of claim 21, wherein the plurality of power supplies comprises using at least first and second power supplies each being arranged to output a DC voltage substantially up to 450 VDC.

* * * * *